US011547627B2

(12) United States Patent
Merino et al.

(10) Patent No.: US 11,547,627 B2
(45) Date of Patent: Jan. 10, 2023

(54) VIBRATING THERAPEUTIC GARMENT

(71) Applicant: Therabody, Inc., Los Angeles, CA (US)

(72) Inventors: Eduardo Merino, Beverly Hills, CA (US); Benjamin Nazarian, Beverly Hills, CA (US); Jaime Sanchez Solana, Los Angeles, CA (US)

(73) Assignee: Therabody, Inc., Los Angeles, CA (US)

( * ) Notice: Subject to any disclaimer, the term of this patent is extended or adjusted under 35 U.S.C. 154(b) by 0 days.

(21) Appl. No.: 17/406,478

(22) Filed: Aug. 19, 2021

(65) Prior Publication Data

US 2022/0054350 A1 Feb. 24, 2022

Related U.S. Application Data

(60) Provisional application No. 63/068,123, filed on Aug. 20, 2020, provisional application No. 63/164,829, filed on Mar. 23, 2021.

(51) Int. Cl.
*A61H 23/02* (2006.01)
*A61H 23/00* (2006.01)

(52) U.S. Cl.
CPC ..... *A61H 23/02* (2013.01); *A61H 23/006* (2013.01); *A61H 2201/0107* (2013.01); *A61H 2201/165* (2013.01); *A61H 2201/1635* (2013.01)

(58) Field of Classification Search
CPC ..... A61H 23/02; A61H 23/006; A61H 2201/0107; A61H 2201/165; A61H 23/008; A61H 23/0254; A61H 2205/06; A61H 2205/10; A61H 2201/0157; A61H 2201/12; A61H 2201/1207; A61H 2201/1215; A61H 2201/1609–1616; A61H 2201/1635–1645; A61H 2201/1652; A61H 2201/1654; A61H 2201/1695; A61H 2201/5007; A61H 2201/5025;
(Continued)

(56) References Cited

U.S. PATENT DOCUMENTS 6,093,164 A * 7/2000 Davis ..... A61H 23/0263 601/46
6,254,554 B1 3/2001 Turtzo
(Continued)

OTHER PUBLICATIONS

BriskHeat Corporation, "BriskHeat HSTAT XtremeFlex Heating Tapes" YouTube video, Nov. 1, 2012, Accessed from URL: https://www.youtube.com/watch?v=tsPyiPJpdRw (Year: 2012).*
(Continued)

*Primary Examiner* — Rachel T Sippel
*Assistant Examiner* — Benjamin M. Kusiak
(74) *Attorney, Agent, or Firm* — Stern, Kessler, Goldstein & Fox P.L.L.C.

(57) ABSTRACT

A garment assembly that includes a first sleeve member, a first vibration assembly associated with the first sleeve member, and a control module. The first vibration assembly includes a plurality of vibration devices that are arranged in a circle about a center point. The angular distance between each vibration device in the plurality of vibration devices is approximately the same. The control module is associated with the first sleeve member, and includes a battery. The first vibration assembly is in electrical communication with the control module.

18 Claims, 6 Drawing Sheets

(58) Field of Classification Search
CPC ..... A61H 23/00004; A61H 23/0218; A61H 23/0236; A61H 23/0245; A61H 23/0263; A61H 2023/002; A61H 2023/0209; A61H 2023/0227; A61H 2023/0272; A61H 2023/0281; A61H 2023/029; A41D 13/08; A41D 27/10
USPC ..... 601/46; 2/59, 125, 126, 16
See application file for complete search history.

(56) References Cited

U.S. PATENT DOCUMENTS 6,537,235 B1 * 3/2003 Connor ..... A61H 23/0263 601/70
7,147,610 B2 * 12/2006 Maalouf ..... A61H 23/02 601/15
8,523,793 B1 * 9/2013 Waldon, Sr. ..... A61H 23/02 601/87
9,161,878 B1 * 10/2015 Pamplin ..... A61H 23/02
10,159,623 B2 12/2018 Leftly
10,610,446 B2 * 4/2020 Shockley, Jr. ..... A61B 5/6805
2005/0209545 A1 * 9/2005 Farrow ..... A61H 1/008 602/75
2006/0064800 A1 * 3/2006 Freund ..... A61F 13/085 2/446
2007/0179421 A1 * 8/2007 Farrow ..... A61H 1/008 602/75
2009/0112134 A1 * 4/2009 Avni ..... A61H 23/0263 601/15
2009/0143706 A1 * 6/2009 Acosta ..... A61H 23/0263 601/46
2009/0143707 A1 * 6/2009 Strahl ..... A61F 5/0106 601/134
2010/0249637 A1 * 9/2010 Walter ..... A61H 23/02 600/544
2011/0257575 A1 * 10/2011 Farrow ..... A61F 13/08 602/75
2011/0277204 A1 * 11/2011 Chan ..... A41D 20/00 2/22
2012/0059294 A1 * 3/2012 Schubert ..... A61P 17/14 601/46
2013/0116606 A1 * 5/2013 Cordo ..... A61H 1/00 601/46
2014/0305441 A1 * 10/2014 Porter ..... A61G 13/121 128/845
2014/0364778 A1 12/2014 Leftly
2015/0272815 A1 * 10/2015 Kitchens ..... A61H 23/0263 601/46
2015/0290028 A1 * 10/2015 Isserow ..... A61N 5/0616 607/109
2016/0008217 A1 * 1/2016 Constantine ..... A61F 13/00051 601/46
2016/0022536 A1 1/2016 Nauman
2016/0184171 A1 * 6/2016 Poole ..... A61H 7/005 601/46
2018/0199635 A1 7/2018 Longinotti-Buitoni
2018/0303704 A1 * 10/2018 Idris ..... A41D 1/005
2019/0015295 A1 * 1/2019 Marton ..... A61H 23/0263
2019/0060159 A1 * 2/2019 Seo ..... A61H 23/0263
2019/0183724 A1 6/2019 Sifferlin
2019/0269880 A1 * 9/2019 Root ..... A61H 23/0245
2020/0022864 A1 * 1/2020 Lee ..... A61H 1/00
2020/0085116 A1 * 3/2020 Harris ..... A61F 7/007
2020/0100981 A1 * 4/2020 Bobey ..... A61H 23/0263
2020/0121550 A1 * 4/2020 Elliot ..... A61H 11/00
2020/0214927 A1 * 7/2020 Clowney ..... A61H 39/04
2021/0093023 A1 * 4/2021 Kuhner-Stout ..... A41H 43/00

OTHER PUBLICATIONS

Philip Ball, "Stretchy Wires Form Bendy Circuits," Mar. 15, 2004. (Year: 2004).*
Muellergroup, "Wire and Cable from the Future," Jan. 3, 2012, accessed from URL: https://muellergroup.wordpress.com/tag/stretchable-wire/ (Year: 2012).*
International Search Report and Written Opinion issued in PCT/US/21/46651.

* cited by examiner

VIBRATING THERAPEUTIC GARMENT

CROSS-REFERENCE TO RELATED APPLICATIONS

This application claims the benefit of U.S. Provisional Application No. 63/164,829, filed on Mar. 23, 2021 and U.S. Provisional Application No. 63/068,123, filed on Aug. 20, 2020, both of which are incorporated by reference herein in their entireties.

FIELD OF THE INVENTION

The present invention relates to a therapeutic garment, and more particularly to a therapeutic garment that includes vibration therein.

BACKGROUND OF THE INVENTION

Massage and therapeutic devices for recovery after working out and the like are known. However, garments, straps or sleeves that include vibration therapy directed to specific body parts or muscles are needed.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention, there is provided a garment assembly that includes a first sleeve member, a first vibration assembly associated with the first sleeve member, and a control module. The first vibration assembly includes a plurality of vibration devices that are arranged in a circle about a center point. The angular distance between each vibration device in the plurality of vibration devices is approximately the same. The control module is associated with the first sleeve member, and includes a battery. The first vibration assembly is in electrical communication with the control module. It will be appreciated that electrical communication can include both power and data communication. In a preferred embodiment, the first vibration assembly includes first, second and third vibration devices. The angular distance between the first vibration device and the second vibration device is approximately 120°, the angular distance between the first vibration device and the third vibration device is approximately 120°, and the angular distance between the third vibration device and the second vibration device is approximately 120°. Preferably, the first, second and third vibration devices define first, second and third axes, respectively, the first, second and third axes are co-planar and the second axis is approximately 120° from the first axis, the third axis is approximately 120° from the first axis, and the third axis is approximately 120° from the second axis.

In a preferred embodiment, the garment assembly includes a second sleeve member disposed within the first sleeve member and the first vibration assembly is sandwiched between the first and second sleeve members. Preferably, the garment assembly includes a first vibration assembly pocket that contains the first vibration assembly and that is defined by stitches that connect the first sleeve member to the second sleeve member and at least partially surround the plurality of vibration devices in the first vibration assembly.

In a preferred embodiment, the garment assembly incudes one or more electrical communication strips that electrically communicates the control module and the vibration assemblies. The electrical communication strip includes at least a first wire that is not straight (so as to provide slack to allow the wire to move when the garment stretches) and that is associated with an elastic band.

In a preferred embodiment, the garment assembly includes one or more tunnel that contain the electrical communication strip(s) and that are defined by stitches that connect the first sleeve member to the second sleeve member and at least partially surround the electrical communication strip. The electrical communication strip(s) extend through the tunnels between the control module and the one or more vibration assemblies.

Preferably, the garment assembly includes a control module pocket that receives at least a portion of the control module (or where the control module is positioned). The battery can be removed from the control module through the control module pocket.

In a preferred embodiment, the first sleeve member includes a distal end and a proximal end and a sleeve length is defined between the proximal end and the distal end. The first sleeve member and/or the second sleeve member (which may be referred to as a sleeve assembly) include(s) a first section with a first compression value and a second section with a second compression value. The second section is defined between the first section and the proximal end and the first compression value is greater than the second compression value. In a preferred embodiment, the first sleeve defines a sleeve length between a distal end and a proximal end, and the first sleeve member comprises a material that includes a range of compression values that decrease between the distal end and the proximal end. The compression values can decrease gradually. The range can include between 2-30 sections or values and preferably between 2-10 sections or values.

Described herein is a garment assembly that includes vibration therapy integrated therein. The garment assembly may be embodied in a sleeve. However, it will be appreciated that this is not a limitation on the present invention and the garment assembly can be any type of wearable garment.

In a preferred embodiment, the garment assembly includes an inner fabric layer or sleeve, an outer fabric layer or sleeve and a vibration layer that includes a plurality of vibration devices. The inner and outer fabric layers sandwich the vibration layer and the vibration devices therebetween. The vibration devices and related components can be housed in a housing (flexible or hard) or secured on a bracket, PCB, or layer.

In a preferred embodiment, the garment assembly also includes sensors. The sensors can be part of the vibration layer, the sensors can be a separate layer or at least some of the sensors can be embedded in or positioned on the inner surface of the inner fabric layer so that the sensor or sensors are positioned adjacent to or in contact with the wearer's skin (e.g., to sense the wearer's heart rate). Any type of sensor or any of the sensors discussed herein can be included. The vibration layer can include a fill material in which the vibration devices are embedded. The vibration layer (or any of the other layers) also include cabling or wiring 2 (and defined pathways therefor) for electrical or data connection or communication between the various components, as necessary.

The vibration devices can be secured to the surface of the inner and/or outer layer. A vibration suppression layer can be included on the outside (e.g., between the vibration devices and the outer layer or outside of the outer layer) to prevent the outer layer or outside of the garment assembly from vibrating or to lessen the vibrations on the outside. A vibration amplifying layer can be included on the inside (e.g., between the vibration devices and the inner layer or inside of the inner layer) to transmit and distribute or spread out the vibrations from the plurality of vibration devices to further be transmitted to the wearer.

In a preferred embodiment, the garment assembly includes wireless communication (e.g., BLUETOOTH®) so that it can communicate with a software application on a mobile device, such as a phone to provide a "smart" garment system. The wireless communication device can be housed on a PCB that may or may not be a part of a control module and that is also in electrical and/or data communication with the vibration devices and various sensors.

The vibration device may include a rotating weight that provides the vibration, a rotating shaft for rotating the weight and coils that generate a magnetic field to rotate the shaft. It will be appreciated that this type of motor is not a limitation on the present invention. Any type of motor that provides the desired vibration or amplitude is within the scope of the present invention. For example, the motor can include an electromagnet coil through which a shaft extends and where the shaft reciprocates (is pushed and pulled) as a result of the magnetic field produced by the coil. The shaft can include some type of member or portion thereon that provides the vibration or percussion on the wearer's skin.

The garment assembly may include vibration modules, assemblies or devices that are disposed anywhere throughout the garment assembly and can be positioned to cover or affect different body parts or muscles. In an embodiment, the vibration modules can be removable. The garment assembly may include a plurality of locations where a vibration module can be secured or attached thereto. This gives the user wearing the garment (e.g., sleeve or shirt) a plurality of options for where to position one or more modules. For example, if the user has a right shoulder issue they are treating, they may only place one or more modules in that location. At a later time they can use the same shirt to treat an abdominal issue.

In a preferred embodiment, the garment assembly is embodied in a knee wrap or sleeve that includes vibration assemblies. The vibration devices may be are embedded in the garment portion (e.g., between inner and outer fabric layers). It will be appreciated that any configuration of vibration devices is within the scope of the present invention. The vibration devices can be configured to treat certain issues and can be placed in patterns around the sleeve or wrap, such as a triangle, star, circle, spiral, other pattern, etc. and can increase blood flow and provide therapeutic benefit as desired.

The garment assembly may include a plurality of magnets that may be overlapping or a single magnet with a plurality of locations where the magnet on the module can be placed in order to allow the modules to be movable or positionable within the same general area. This allows the user to move the module to the exact location of the issue. It also allows a single garment size to be usable by different uses (because no two bodies are exactly the same). In another embodiment, the majority of or all of the garment can be magnetized, thus allowing the module to attach anywhere.

In a preferred embodiment, the invention includes a smart vibration system. It will be appreciated by those of ordinary skill in the art that at a certain frequency (depending on the mass attached to the system), vibrations can make a user's body resonate and therefore increase the amplitude of the perceived vibration. To take advantage of this resonant frequency principle (which is different from person to person and from body part to body part), the present invention may include a closed loop system with sensors that scan through the different speeds of the vibration devices or motors until the resonant frequency is found. One way to achieve this is by adding accelerometers near the motor locations that can measure the actual vibration it is being generated when the motor is attached to the body part. In an exemplary embodiment, strain gages that can measure displacement of the garment are included in the location of the motor.

In a preferred embodiment, the garment assembly is washable and includes at least some components that are embedded in, attached to, etc. permanently in the garment (e.g., waterproof enclosed motors, cabling, etc) and other components that are removable (battery pack, control module, PCB). The permanent components are preferably sealed in the garment (e.g., between garment layers and the user can wash the garment after removing the power unit system (battery pack, control module, PCB, etc.).

One or more of the layers of the device can include vibration capability. The modules or assemblies may be different sizes depending on the muscle group or the surface area desired be treated. The device (or separate devices) may also include different sized and shaped straps to accommodate different body parts.

In a preferred embodiment, the garment assembly includes a control member and/or battery pack secured to or associated with the garment. In this embodiment the battery pack may also be removable (e.g., it is clipped onto the garment or placed in a pocket). The controller can be electrically connected to and in data communication with the modules so that the modules are powered and can be controlled by the controller. Wiring can be included connecting the battery pack/controller to the modules. The wiring can be embedded in the main body portion and plugs or jacks can be used for attaching and detaching the electrical connections. The wiring can also be external. Wireless connectivity between any and/or all components can also be included.

In another embodiment, a battery can be located in the module, thus making each module independent and interchangeable such that it can be simply placed in the cavity or a strap garment assembly or secured via a magnet or other attachment mechanism to a "wearable" garment assembly. It will be appreciated that the main body portion is made of a material that is pliable and flexible enough to allow the modules to be inserted into the cavities and removed therefrom (e.g., pressed into place and removed therefrom). Vibration devices can also be included embedded in the main body portion or strap portions. It will be appreciated that any and all of the embodiments discussed or disclosed herein and any of the components or concepts included in the embodiments are all completely interchangeable, swappable and usable together. It will be appreciated that strap assemblies, wraps or sleeves can be configured to fit any body part or multiple body parts, e.g., shoulder, back, knee, elbow, wrist, neck, ankle, etc.

The control module or assembly may include a plurality of buttons or switches thereon for controlling the vibration modules. For example, the control module may include a button that turns the device on and off, button(s) for controlling the time or duration, button(s) for changing modes, and button(s) for controlling the vibration devices and turning them on and/or off for various body parts and LED lights related thereto (such as charging indicator(s) and time light indicator(s)). Some of the features are controlled by multiple pushes of the associated button. In an exemplary embodiment, the buttons may work as follows. Pushing the mode button may cycle through the following vibration patterns—constant, wave, regular, wave, off. The time button—one press sets to thirty minutes, two presses sets to sixty minutes, third press for unlimited time. Different vibration assemblies can be activated at different times or for different periods.

One of the advantages of the present invention is the ability to provide flexibility so that the modules can be used on, for example, strap devices and garment or wearable devices. Mounting the modules on strap devices provides high performance and efficacy. The strap allows for multiple modules to work together and treat a wide area. Mounting the modules on a wearable device (e.g., shirt, pants, shorts, etc.) provides the user with the a In preferred embodiments, the garment assemblies can be embodied in arm, leg and calf compression garment assemblies that includes a plurality of vibration assemblies or modules, a battery pack and control module. The battery pack and control module can be located within the same module or assembly. Preferably, at least one of the inner and outer fabric layer(s) are made of a compressive or spandex material so that the garment assembly is form fitting on the wearer's body part. In a preferred embodiment, the vibration modules are received in pockets formed in the garment portion (e.g., between the inner and outer garment layers). The vibration modules can be permanently sewn in the pockets or may be removable. In a preferred embodiment, the battery pack is removable. In another embodiment, the battery pack can be permanent and rechargeable within the garment assembly.

The garment assembly can include BLUETOOTH® BLE wireless connectivity and connections for connecting the battery to the garment assembly, wiring connections, and conductive pathways through and between the inner or outer fabric layer(s) or textile arm sleeve. In an embodiment, the control module is removable together with the battery module as a unit. The control module can include user interface with a plurality of buttons that allow the user to perform functions such as turning the device on and off, activating different vibration modules, starting different routines or preset functions (e.g., pulse, cycle through vibration modules), etc.

The garment assembly may include an outer fabric layer, module or assembly layer, outer film layer (part of the vibration module and covering the vibration motors), electronics layer (the control module), and inner film layer (part of the vibration module and secured on the inner fabric layer). In a preferred embodiment, the vibration motors are arranged in a triangle pattern. In tests, the inventors have determined that this triangular shape intensifies the vibration on the skin or at least increases the vibration intensity perception in the user. In other words, the vibration on the user's skin provided by the three vibration motors arranged in a triangular configuration is greater than the vibration provided by a single vibration motor. In a preferred embodiment, three vibration motors are arranged about 120° apart from one another. In other words, the axis of each vibrating motor is 120° from the axis of the adjacent vibrating motor. Through testing different patterns, the inventors have identified this triangular shape arrangement. In a preferred embodiment, the vibration motors or devices are placed directly in between layers of fabric and secured by adding one or more stitches around each motor.

Any type of manufacturing process is within the scope of the present invention. For example, a cut and sew method can be used where the various layers are cut from layers, pieces or panels of fabric and then sewn together. A knitting method can also be used. With knitting, the thickness, compression level, stretchability and other properties can be varied throughout the garment and/or the individual layers. This method can be performed without the need for any or many seams and is similar to 3D printing. In a preferred embodiment, the garment assembly includes two layers of knitted material with different zones and then the motors and electrical wires and/or cables are sandwiched therebetween and a single seam is used to close the sleeve lengthwise (e.g., along the arm or leg) to create the sleeve interior through which a body part is placed. In a preferred embodiment, the wires are part of a flexible or stretchable electronics (or electrical communication) layer, strip or the like. The wires are embedded or stitched into a stretchable fabric member in a pattern (e.g., a wave or zig zag pattern) that provides slack in the wires so that when the stretchable fabric member stretches during use, the wires can move and do not tighten. The electrical communication strip extends between the various vibration modules or assemblies and the battery and/or control module. In a preferred embodiment, the garment assembly includes a docking station or area where the removable and rechargeable battery can be docked to provide power as necessary. The docking station is part of or includes the control module and most, if not all, of the components for controlling the operation of the garment assembly. Preferably, the docking station includes one or more magnets therein that mate or are attracted to one or more magnets in the battery to aid with proper connection and alignment of the battery.

In a preferred embodiment, the garment assembly includes wireless communication (e.g., BLUETOOTH®) so that it can communicate with a software application on a mobile device, such as a phone to provide a "smart" garment system. The wireless communication device can be included on a PCB in the control module that is also in electrical and/or data communication with the vibration devices and various sensors.

The garment assembly can include any of the other features or components discussed herein, and the garment assembly can also include blood flow sensors that provides biometric information to the user regarding whether the device should be used.

In a preferred embodiment, the garment or sleeve includes graded or graduated compression that includes compression that differs over a given distance or over the length of the garment or sleeve. In these garments compression at the distal end (furthest from the heart) is preferably greater than that found at the proximal end (closest to the heart). This compression gradient helps provide improvement in circulation of blood back to the heart. For example, the inventors have learned that in the lower body (e.g., the legs) the minimum compression required to improve venous return is 17.3 mmHg at the calf, decreasing to 15.1 mmHg at the quadriceps. The compression gradient may be gradual between the distal end and the proximal end or the garment may include two or more sections that each have different compression values. For example, an arm sleeve may include a compression of 20 mmHg at the wrist and 15 mmHg at the shoulder. The compression gradient can change gradually (e.g., in increments of 1 mmHg) over the length of the sleeve or the sleeve can include a first section below the elbow (between the wrist and elbow) where the compression is approximately 20 mmHg and a second section above the elbow (between the elbow and the upper arm or shoulder) where the compression is approximately 15 mmHg. The compression value within any portion of the sleeve or garment assembly can be between, for example, approximately 15-20 mmHg for the arm, approximately 10-15 mmHg for the upper leg and approximately 20-30 mmHg for the calf. Approximately means that the value can be within 2 mmHg at either end of a range.

Preferably, the garment assembly also provides localized vibration at the area of the vibration assembly. Local vibration provides rapid oscillatory movement of the tissue and can help increase local blood flow and tissue oxygenation. Pre-exercise local vibration may also be protective, reducing swelling, attenuating the biochemical response to muscle damage, and decreasing pain associated with delayed onset muscle soreness (DOMS).

Furthermore, through the stimulus of sensory afferents and mechanoreceptors vibration has been observed to decrease muscle tone, potentiate the stretch reflex, decrease acute muscle pain, and in deconditioned muscles vibration alone may be enough to increase strength. The present invention combines the benefits of compression and vibration into one garment to help the wearer perform and recover. Local vibration has been shown to have both prophylactic and reactive benefits related to circulation, recovery, and pain. Furthermore, it has been associated with being able to help different medical conditions related to both circulatory and neurological disease states. The vibration devices can include vibration frequencies of between 0-300 Hz and vibration amplitudes of between 0.5-12 mm.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
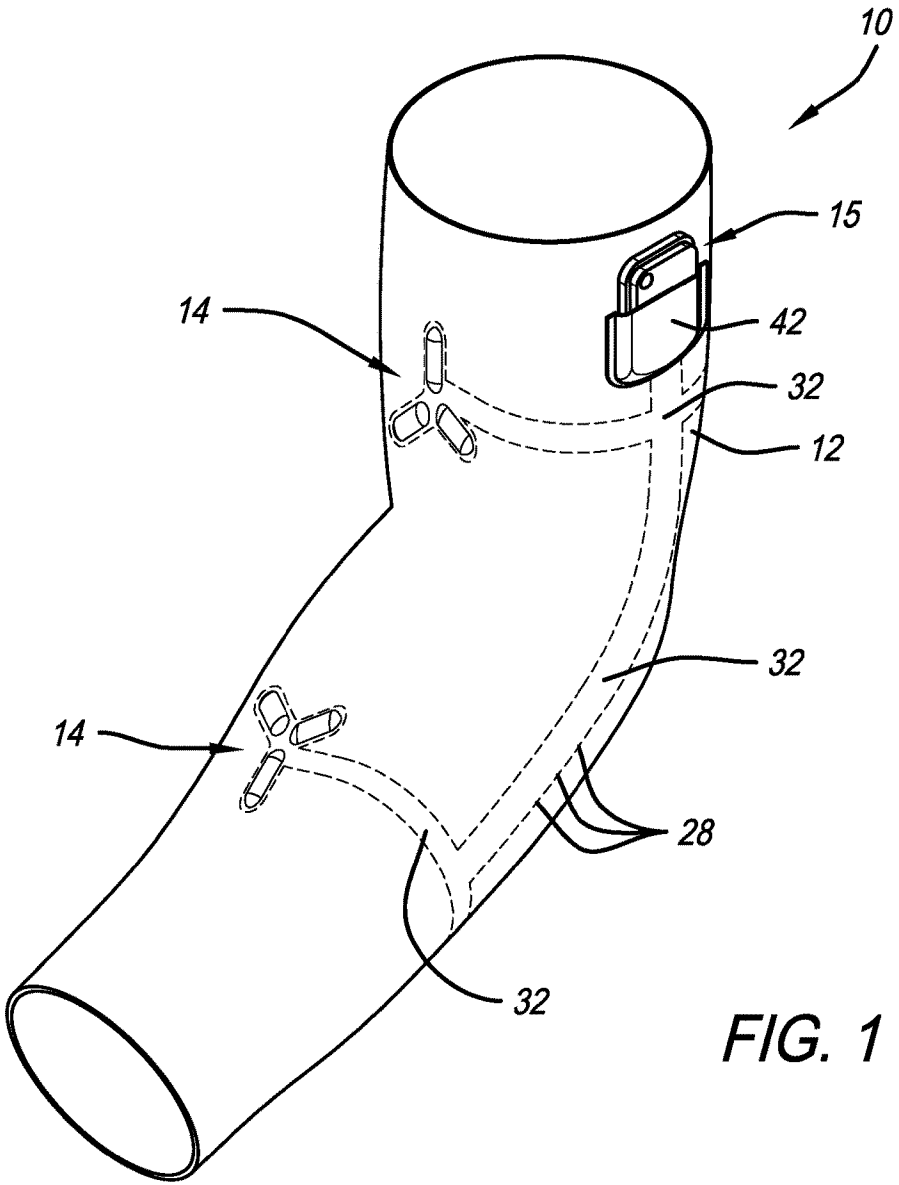
FIG. 1 is a perspective view of a vibrating garment assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, the drawings show a vibrating garment or sleeve that provides compression and/or vibration therapy to a wearer. It should be appreciated that the garment can take any wearable form, e.g., a sleeve, shirt, shorts, pants, bodysuit, etc. The drawings include an exemplary embodiment where the garment is a compression sleeve that is wearable on the user's arm or leg. However, this is not a limitation on the present invention. FIGS. 1-7 show the garment or garment assembly 10 in accordance with a preferred embodiment of the present invention.

Figure 3:
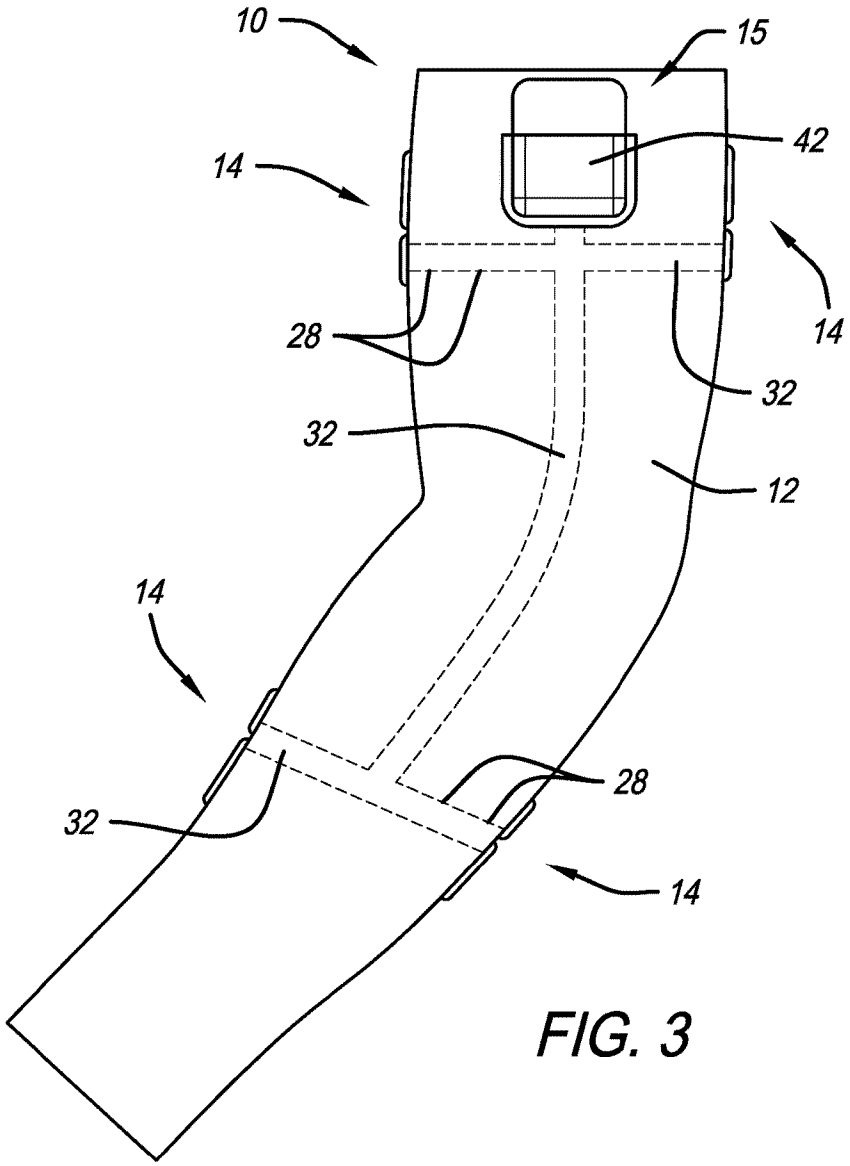
FIG. 3 is a side elevational view of the vibrating garment assembly.
Figure 2:
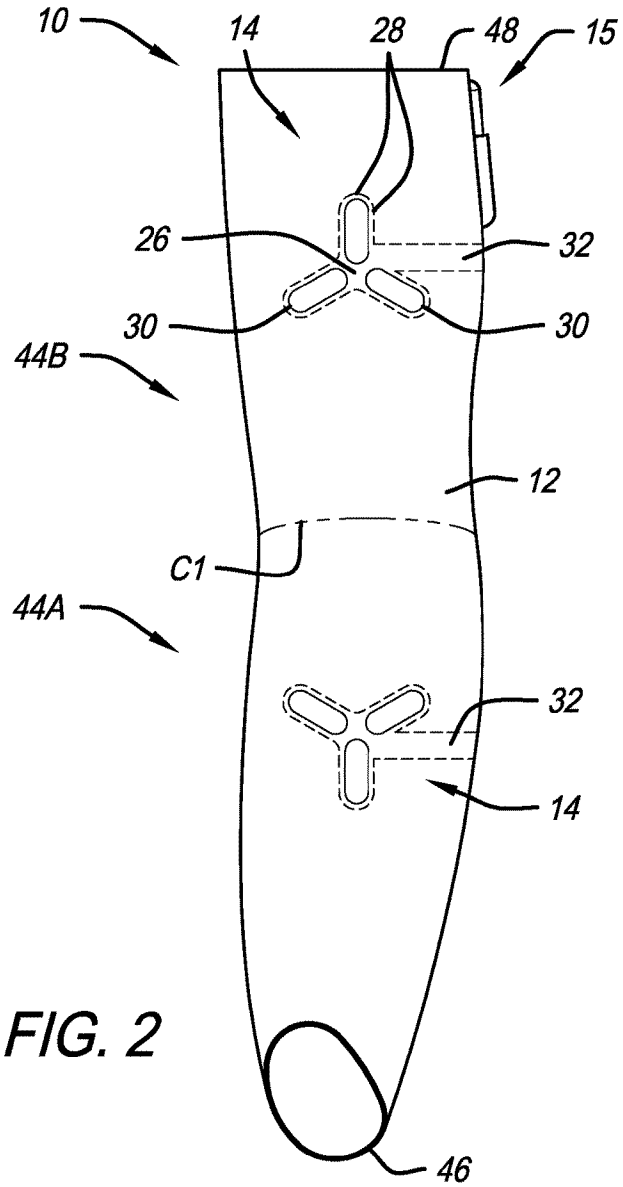
FIG. 2 is a front elevational view of the vibrating garment assembly.
Figure 4:
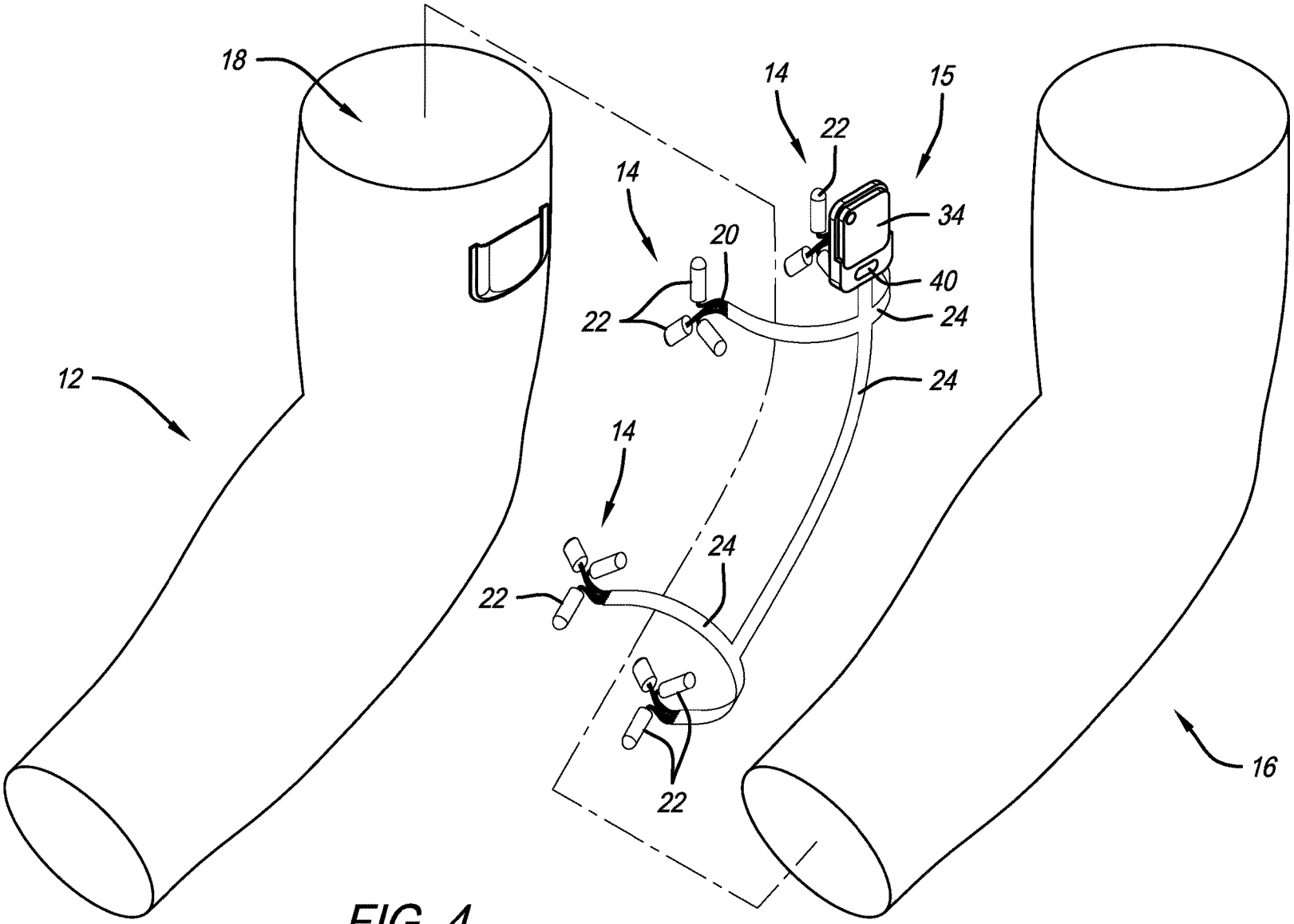
FIG. 4 is an exploded perspective view of the vibrating garment assembly.

As shown in FIGS. 1-3, in a preferred embodiment, the garment assembly 10 generally includes an outer or first sleeve member 12, one or more vibration assemblies 14 and a control module 15. As shown in FIG. 4, in a preferred embodiment, the garment assembly 10 includes an inner or second sleeve member 16 that is positioned or disposed in the sleeve interior 18 of the first sleeve member 12. The vibration assemblies 14 and the other associated components, such as the wires 20 are sandwiched between the first sleeve member 12 and the second sleeve member 16. In another embodiment, instead of a full inner sleeve, patches or panels can be utilized to sandwich the vibration assemblies therebetween.

The vibration assemblies 14 preferably include a plurality of vibration devices 22 in a cluster or arrangement. Any number of vibration devices 22 (e.g., 1-10) can be included in a vibration assembly. Furthermore, the vibration devices can be any type of vibration motor or device. For example, the vibration devices can be puck shaped, similar to the vibration device used in a cell phone. In the embodiment shown in the drawings, the vibration devices 22 are cylindrical in shape. In a preferred embodiment, the vibration assembly 14 includes three or first, second and third vibration devices 22*a*, 22*b* and 22*c* that are arranged in a pattern as shown best in FIG. 5. As shown, the first, second and third vibration devices 22*a*, 22*b* and 22*c* are arranged in a circular pattern about a center point P1 and are each positioned an angle A1 from one another. Preferably, the angular distance or separation between each vibration device in the set or assembly is approximately the same. In a preferred embodiment, where three vibration devices are used, the second vibration device 22*b* is approximately 120° from the first vibration device 22*a*, the third vibration device 22*c* is approximately 120° from the first vibration device 22*a*, and the third vibration device 22*c* is approximately 120° from the second vibration device 22*b*. As used herein, the term "approximately" provides a range of within plus or minus 5°. In a preferred embodiment angle A1 (the angular distance) is the same or approximately the same between all vibration devices.

Figure 5:
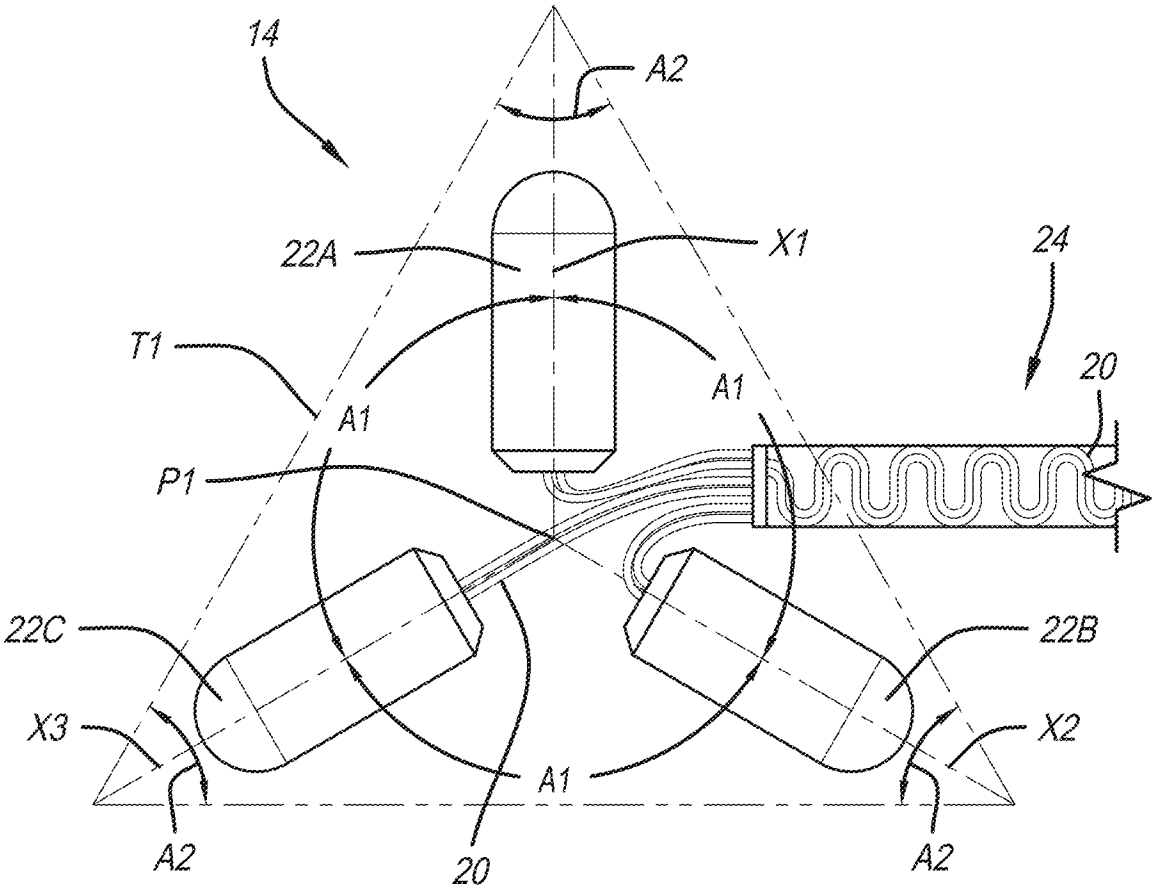
FIG. 5 is an elevational view of the vibration assembly.

As is shown in FIG. 5, in a preferred embodiment, the first, second and third vibration devices 22*a*, 22*b* and 22*c* define first, second and third axes X1, X2 and X3. The first, second and third axes are co-planar (and extend generally parallel with the outer and inner surfaces of the garment assembly and the wearer's skin). It will be appreciated that when the garment assembly is worn, due to the undulations in the human body, the axes will not be co-planar. However, when the portion of the garment assembly that includes the vibration assembly is placed on a flat surface, the first, second and third vibration devices will be arranged as shown in FIG. 5. In this position, the axes are co-planar and this is the arrangement for purposes of the claims. As shown in FIG. 5, in this arrangement, the second axis X2 is approximately 120° from the first axis X1, the third axis X3 is approximately 120° from the first axis X1, and the third axis X3 is approximately 120° from the second axis X2 and the axes all pass through the center point P1.

FIG. 5 also includes a triangle T1 shown therein. This provides another way to quantify the arrangement of the vibration devices 22. Triangle T1 is an equilateral triangle (with angles A2 of 60°) with the first, second and third axes X1, X2 and X3 extending to and/or through the corners of the triangle. It will be appreciated that different shaped vibration devices can be used. For example, if puck or disk shaped vibration devices are used, the first, second and third axes may extend perpendicular to the outer and inner surfaces of the garment assembly and the wearer's skin. In such an arrangement, angle A1 may be measured from the center of the circular vibration device.

In a preferred embodiment, the wires 20 are part of a flexible or stretchable electronics (or electrical communication) layer, strip or the like (referred to herein as an electrical communication strip 24). The wires 20 are embedded or stitched into the electrical communication strip 24 in a pattern that provide slack in the wires 20 so that when the electrical communication strip 24 stretches during use, the wires 20 can move and do not tighten. See the pattern of the wires shown in FIG. 5.

In a preferred embodiment, the first sleeve member 12 is secured to the second sleeve member 16 at various locations using stitching 28. In a preferred embodiment, each vibration assembly 14 is housed or contained in a vibration assembly pocket 26. Preferably, the vibration assembly pocket 26 is defined or created by stitches 28 that extend closely around the outside of the vibration devices 22 and connect the first sleeve member 12 to the second sleeve member 16. As shown in FIG. 2, each the vibration assembly pocket 26 includes a plurality of pocket fingers 30, one for each vibration device 22. Preferably, the electrical communication strips 24 are housed or located within tunnels 32 that are created by connecting and/or stitching 28 the first and second sleeve members to one another, as shown in FIGS. 1-3.

As discussed herein, the material of the first and second sleeves and other portions of the garment assembly 10 (e.g., the electrical communication strip 24) can be made of an elastic, stretchable or compression material so that the garment provides compression to the body part that it is worn on. In a preferred embodiment, the garment assembly includes a compression gradient or change at one or more points or places between the distal end 46 and the proximal end 48 and along the length of the sleeve (see FIG. 2). The compression gradient may be gradual between the distal end 46 and the proximal end 48 or the garment may include two or more sections that each have different compression values. FIG. 2 shows first and second sections 44*a* and 44*b* that each include a different compression value. See dividing line Cl in FIG. 2, which delineates the change in compression value between the first or distal section 44*a* and the second or proximal section 44*b*. For example, the first section 44*a* may have a compression value of approximately 20 mmHg and the second section 44*b* have a compression value of approximately 15 mmHg. The sleeve may include more than two sections (e.g., 2-10 distinct sections). Or, the sleeve can be knitted or otherwise manufactured so that the compression changes gradually along at least a portion of the length of the sleeve such that the sleeve as a first compression value at the distal end and a second compression value at the second end, but the compression values gradually change over the length of the sleeve from the first compression value to the second compression value.

Figure 6:
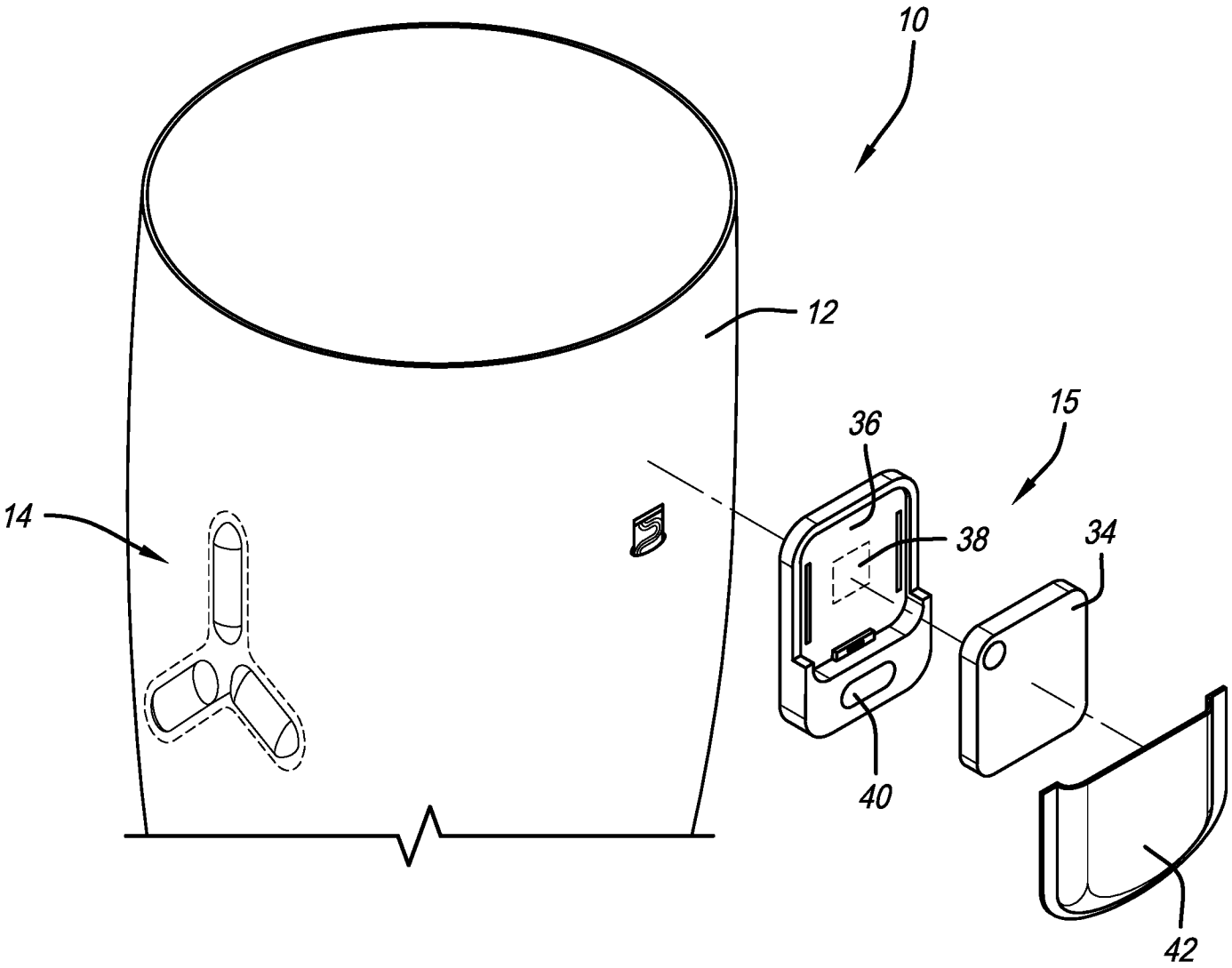
FIG. 6 is an exploded perspective view of a portion of the vibrating garment assembly and showing the control module.
Figure 7:
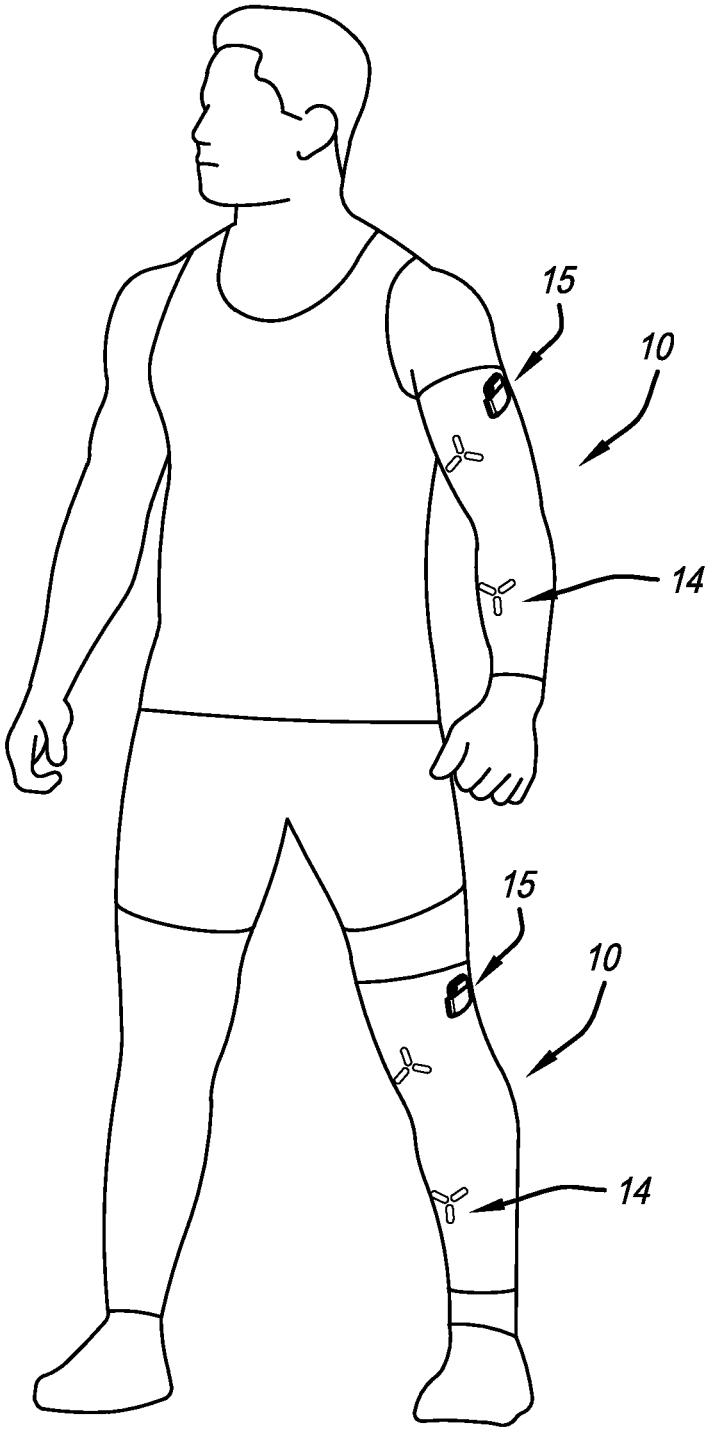
FIG. 7 is a depiction of a person wearing vibrating garment assemblies on their arm and leg.

As shown in FIG. 6, in a preferred embodiment, the control module 15 preferably includes a battery 34 that is received in a docking station 36. The docking station 36 may include a magnet 38 that is magnetically attracted to a magnet in the battery to help dock the battery in the docking station 36. The control module 15 can also include a switch or button 40 for turning the device on and off and/or cycling through different modes, frequencies and the like. In another embodiment, multiple switches or buttons can be used. The interior of the control module 15 preferably includes the memory, PCB, programming, wireless connection module and other electronics to control the device as desired and as described herein. As shown in FIG. 1, in a preferred embodiment, the control module 15 and the various components thereof are housed in a pocket 42 or other securing member. The pocket 42 can cover some or all of the control module 15. The entire control module can be removable or the docking station can be permanently attached (via stitching, welding or the like) to one or both of the inner and outer sleeves and the battery can be removable or replaceable. The control module and/or the battery can also have a port (e.g., USB-c) for charging, data connection, etc.

In a preferred embodiment, the vibration assemblies 14 are strategically located to target or provide therapy or vibration to certain body parts or muscles. For example, for the arm sleeve or garment assembly shown in FIGS. 1-7, four vibration assemblies 14 are included that are positioned over or adjacent to the bicep(s), tricep(s) and front and back of the forearm areas or muscles. In the leg sleeve or garment assembly shown in FIG. 7, the vibration assemblies 14 are positioned over or adjacent to the quadricep(s), hamstring (s), shin and calf areas or muscles. It will be appreciated that the term sleeve does not limit the garment assembly to be a single hollow sleeve for the arms or legs. A garment assembly that surrounds the torso, midsection, pelvic area, shoulders or any other body part (e.g., shirts, shorts, pants, straps, etc.) is/are also considered sleeves.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A garment assembly comprising:

a first sleeve member, a first vibration assembly associated with the first sleeve member, wherein the first vibration assembly includes only first, second, and third vibration motors that are arranged angularly adjacent to one another in a circle about a center point, each of the first, second, and third vibration motors having elongate shapes extending along first, second, and third axes, respectively, and along respective portions of the first sleeve member, wherein an angular distance between the first axis and the second axis is approximately 120°, an angular distance between the first axis and the third axis is approximately 120°, and an angular distance between the third axis and the second axis is approximately 120°, and a control module associated with the first sleeve member, wherein the control module includes a battery, and wherein each of the first, second, and third vibration motors in the first vibration assembly is configured to be in electrical communication with the control module.

2. The garment assembly of claim 1, wherein the first, second, and third axes are co-planar.

3. The garment assembly of claim 2, wherein the first, second, and third vibration motors each have a cylindrical shape that defines the first, second, and third axes respectively, such that the first, second, and third axes extend generally parallel with an inner surface of the first sleeve member.

4. The garment assembly of claim 1, further comprising a second sleeve member disposed within the first sleeve member, wherein the first vibration assembly is sandwiched between the first and second sleeve members.

5. The garment assembly of claim 1, further comprising a first vibration assembly pocket that contains the first vibration assembly, wherein the first vibration assembly pocket at least partially surrounds the first, second, and third vibration motors in the first vibration assembly.

6. The garment assembly of claim 1, further comprising an electrical communication strip that is configured to provide electrical communication between the control module and the first vibration assembly, wherein the electrical communication strip includes a stretchable fabric member and at least a first wire that is embedded in the stretchable fabric member, wherein the first wire is formed in a wave or zig zag pattern, wherein the stretchable fabric member is configured to stretch in a longitudinal direction and the first wire in the wave or zig zag pattern is configured to straighten when the stretchable fabric member is stretched.

7. The garment assembly of claim 6, further comprising a tunnel that contains the electrical communication strip, wherein the tunnel at least partially surrounds the electrical communication strip.

8. The garment assembly of claim 1, further comprising a second vibration assembly associated with the first sleeve member, wherein the second vibration assembly includes only first, second, and third vibration motors that are arranged in a circle about a center point, wherein the angular distance between each vibration motor of the first, second, and third vibration motors of the second assembly is approximately the same, wherein the first vibration assembly is configured to be positioned to target a first body part and the second vibration assembly is configured to be positioned to target a second body part when the garment assembly is worn by a user.

9. The garment assembly of claim 1, further comprising a control module pocket that receives at least a portion of the control module, wherein the battery is configured to be removed from the control module through the control module pocket.

10. The garment assembly of claim 5, wherein the vibration assembly pocket includes a plurality of pocket fingers, one pocket finger for each vibration motor of the first, second, and third vibration motors.

11. The garment assembly of claim 1, wherein the first sleeve member includes a distal end and a proximal end, and a sleeve length is defined between the proximal end and the distal end, wherein the first sleeve member includes a first section with a first compression value and a second section with a second compression value, wherein the first sleeve member is formed by a knitting process, wherein the first section is knitted to provide the first compression value and the second section is knitted to provide the second compression value.

12. The garment assembly of claim 11, wherein the second section is defined between the first section and the proximal end, and wherein the first compression value is greater than the second compression value.

13. The garment assembly of claim 1, wherein the first sleeve member defines a sleeve length between a distal end and a proximal end, wherein the first sleeve member comprises a material that includes a range of compression values that decrease between the distal end and the proximal end, wherein the first sleeve member is formed by a knitting process, and wherein the knitting process causes the material to include the range of compression values that decrease between the distal end and the proximal end.

14. A garment assembly comprising:

a sleeve assembly that includes a first vibration assembly pocket, a first vibration assembly positioned in the first vibration assembly pocket, wherein the first vibration assembly includes only first, second, and third cylindrical vibration motors that are arranged angularly adjacent to one another in a circle about a center point, wherein the first, second, and third vibration motors define first, second, and third axes, respectively, wherein the first, second, and third axes are co-planar, wherein the second axis is approximately 120° from the first axis, the third axis is approximately 120° from the first axis, and the third axis is approximately 120° from the second axis, wherein the first, second, and third vibration motors each have a cylindrical shape that defines the first, second, and third axes respectively, such that the first, second, and third axes extend generally parallel with an inner surface of the first sleeve member, wherein the first vibration assembly pocket includes first second and third pocket fingers, wherein the first vibration motor is received in the first pocket finger, the second vibration motor is received in the second pocket finger, and the third vibration motor is received in the third pocket finger, a control module that includes a battery, at least a first electrical communication strip that is configured to provide electrical communication between the control module and the first vibration assembly, wherein the electrical communication strip includes a plurality of wires that are associated with an elastic band, wherein the sleeve assembly includes a tunnel that contains the first electrical communication strip, and a control module pocket that receives at least a portion of the control module, wherein the battery is configured to be removed from the control module through the control module pocket, wherein each of the first, second, and third vibration motors in the first vibration assembly is in electrical communication with the control module, and wherein the tunnel extends between the control module pocket and the first vibration assembly pocket.

15. The garment assembly of claim 14, wherein the sleeve assembly defines a sleeve length between a distal end and a proximal end, wherein the sleeve assembly comprises a material that includes a range of compression values that decrease between the distal end and the proximal end, wherein the sleeve assembly is formed by a knitting process, and wherein the knitting process causes the material to include the range of compression values that decrease between the distal end and the proximal end.

16. The garment assembly of claim 15, wherein the first electrical communication strip includes a stretchable fabric member, wherein the plurality of wires are embedded in the stretchable fabric member, wherein the first wire is formed in a wave or zig zag pattern, wherein the stretchable fabric member is configured to stretch in a longitudinal direction and the first wire in the wave or zig zag pattern is configured to straighten when the stretchable fabric member is stretched.

17. The garment assembly of claim 1, wherein the first sleeve member is a compression sleeve including a section having a compression value of approximately 20-30 mmHg.

18. The garment assembly of claim 17, wherein the first sleeve member is configured to apply the compression value around a circumference of a wearer's limb.

* * * * *